US005890660A

United States Patent [19]

Stevens

[11] Patent Number: 5,890,660

[45] Date of Patent: Apr. 6, 1999

[54] FUEL INJECTION NOZZLE

[75] Inventor: John William Stevens, Hempstead, Great Britain

[73] Assignee: Lucas Industries Public Limited Company, Great Britain

[21] Appl. No.: 849,911

[22] PCT Filed: Dec. 11, 1995

[86] PCT No.: PCT/GB95/02880

§ 371 Date: Jun. 18, 1997

§ 102(e) Date: Jun. 18, 1997

[87] PCT Pub. No.: WO96/19661

PCT Pub. Date: Jun. 27, 1996

[30] Foreign Application Priority Data

Dec. 20, 1994 [GB] United Kingdom ..... 9425652

[51] Int. Cl.[6] ..... F02M 39/00

[52] U.S. Cl. ..... 239/533.3; 239/533.9; 239/584

[58] Field of Search ..... 239/533.1, 533.2, 239/533.3, 533.9, 583, 584

[56] References Cited

U.S. PATENT DOCUMENTS

| | | | |
|---|---|---|---|
| 1,952,816 | 3/1934 | Mock | 239/533.2 |
| 3,980,237 | 9/1976 | Parrish, Jr. | 239/533.2 |
| 4,153,205 | 5/1979 | Parrish, Jr. | 239/533.9 |
| 4,470,548 | 9/1984 | Ushimura | 239/533.3 |
| 4,528,951 | 7/1985 | Yamada | 123/300 |
| 5,033,679 | 7/1991 | Golev et al. . | |
| 5,110,053 | 5/1992 | Stevens | 239/533.9 |
| 5,725,157 | 3/1998 | DeLuca | 239/533.9 |

FOREIGN PATENT DOCUMENTS

| | | |
|---|---|---|
| A0 345 348 | 12/1989 | European Pat. Off. . |
| A0 460 326 | 12/1991 | European Pat. Off. . |
| A41 17 910 | 12/1992 | Germany . |
| A562 033 | 6/1944 | United Kingdom . |

*Primary Examiner*—Andres Kashnikow
*Assistant Examiner*—Lisa Ann Douglas
*Attorney, Agent, or Firm*—Fulbright & Jaworski L.L.P.

[57] ABSTRACT

A fuel injection nozzle is disclosed which comprises a value needle slidable within a bore and biased by a spring into engagement with a seating of conical form wherein the valve needle includes an upstream conical region of cone angle slightly larger than the seating and a downstream conical region of cone angle slightly smaller than the seating, and an annular groove provided between the upstream and downstream regions wherein an upstream edge of the groove forms with the upstream region a seating line along which the valve needle engages the seating when the valve needle is in its closed position.

5 Claims, 1 Drawing Sheet

FUEL INJECTION NOZZLE

TECHNICAL FIELD

This invention relates to fuel injection nozzles for supplying fuel to compression ignition engines, the nozzles being of the kind comprising an inwardly opening valve member which is slidable in a bore, resilient means biasing the valve member into engagement with a seating, the valve member being shaped to define with the seating when in engagement therewith, a so called seating line, the valve member being lifted from the seating against the action of the resilient means by fuel under pressure which acts on an annular end area of the valve member, the inner boundary of which is defined by the seat line, the valve member when lifted from the seating allowing fuel flow past the seating to an outlet orifice.

BACKGROUND ART

It is known from the prior art described in U.S. Pat. No. 4,153,205 and in U.S. Pat. No. 3,980,237 to form the valve member so that the seating line is defined by the meeting line of two conical surfaces the upstream one of which has a cone angle which is less than the cone angle of the frusto conical seating and the downstream one of which has a cone angle which is greater than that of the seating. In one example the included angle between the conical surface of the seating and the downstream conical surface of the valve member is greater than the included angle between the conical surface of the seating and the upstream conical surface of the valve member. With this arrangement as the surfaces wear the effective seating line moves in the upstream direction so that the nozzle opening pressure increases assuming that there is no substantial deterioration in the force exerted by the resilient means. The disadvantage of this arrangement is that the greater included angle between the downstream conical surface of the valve member and the seating results in an increased volume of fuel trapped in the space between the seating line and the outlet orifice when the valve member is in the closed position. This fuel can dribble through the orifice into the engine and cause unwanted exhaust emissions. If the included angle downstream of the seating line is reduced the aforesaid volume of fuel is reduced but there is an increasing tendency for the effective seating line to move in the downstream direction particularly if the downstream included angle is less than the upstream included angle. As a result the area of the valve member exposed to the fuel pressure in the closed position of the valve member increases and the nozzle opening pressure falls so that there is a deterioration in the performance of the nozzle.

U.S. Pat. No. 4,153,205 also describes how a groove may be formed in the downstream conical surface of the valve member, the groove being spaced in the downstream direction from the seating line. The downstream included angle is less than the upstream included angle and the action of the groove is to minimise the movement as wear takes place, of the seating line in the downstream direction. Thus whilst in use there will be a reduction of the nozzle opening pressure the extent of the reduction will be limited by the action of the groove.

GB 2186632 describes a nozzle arrangement including a nozzle body having an inner conical seating, and a valve needle including a conical surface engageable with the seating, the conical surface of the valve needle being interrupted by an annular groove or slot arranged to alter the flow characteristics of fuel through the nozzle when the valve needle is lifted from the seating. A similar annular groove is provided in the arrangement described in U.S. Pat. No. 1,952,816, in this case the groove being upstream of the effective seating line of the nozzle The object of the present invention is to provide a fuel injection nozzle of the kind specified in an improved form.

DISCLOSURE OF THE INVENTION

According to the invention in a fuel injection nozzle of the kind specified the seating is machined to frusto conical form with a constant cone angle and the valve member is machined to define two conical surfaces, the downstream one in terms of the direction of flow of fuel through the outlet orifice, having a cone angle which is greater than that of the seating and the upstream one having a cone angle less than that of the seating, and a circumferential groove formed in the valve member, the upstream edge of said groove forming with the upstream conical surface a seating line along which in the closed position of the valve member the valve member engages with the seating, the downstream edge of said groove lying on the downstream conical surface.

BRIEF DESCRIPTION OF THE DRAWINGS

An example of a fuel injection nozzle in accordance with the invention will now be described with reference to the accompanying drawings in which.

DETAILED DESCRIPTION OF THE INVENTION

Figure 1:
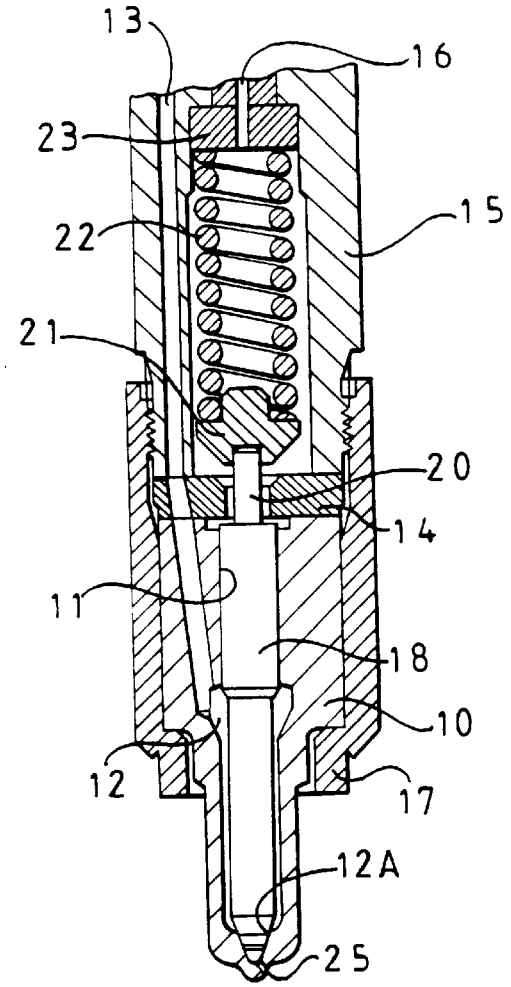
FIG. 1 is a sectional side elevation of part of a fuel injection nozzle.

Referring to the drawings the fuel injection nozzle comprises a nozzle body 10 of stepped cylindrical form and within the body and extending from the wider end thereof there is formed a blind bore 11. At the blind end of the bore there is formed a seating 12A which is shown more clearly in FIG. 2. Intermediate the ends of the bore there is formed an enlargement 12 which communicates with a fuel inlet passage 13. The fuel inlet passage 13 extends through a distance piece 14 and a nozzle holder 15 to a fuel inlet which in use is connected to the outlet of a fuel injection pump.

The nozzle body is secured to the holder 15 by means of the usual cap nut 17 and in use the narrower portion of the nozzle body passes through a bore into a combustion space of the associated engine.

Slidable within the bore 11 is a valve member 18. The valve member intermediate the enlargement 12 and the seating is of reduced diameter so as to define an annular space 19 through which fuel can flow when the valve member is in the open position.

The valve member 18 is provided with an extension 20 which extends with clearance through an aperture in the distance piece 14. The extension 20 is engaged by a spring abutment 21 against which is located one end of a coiled compression spring 22 the other end of which bears against an abutment 23. The spring acts to maintain the valve member in the closed position and the chamber in which the spring is located is connected to a drain through a passage 16.

Figure 2:
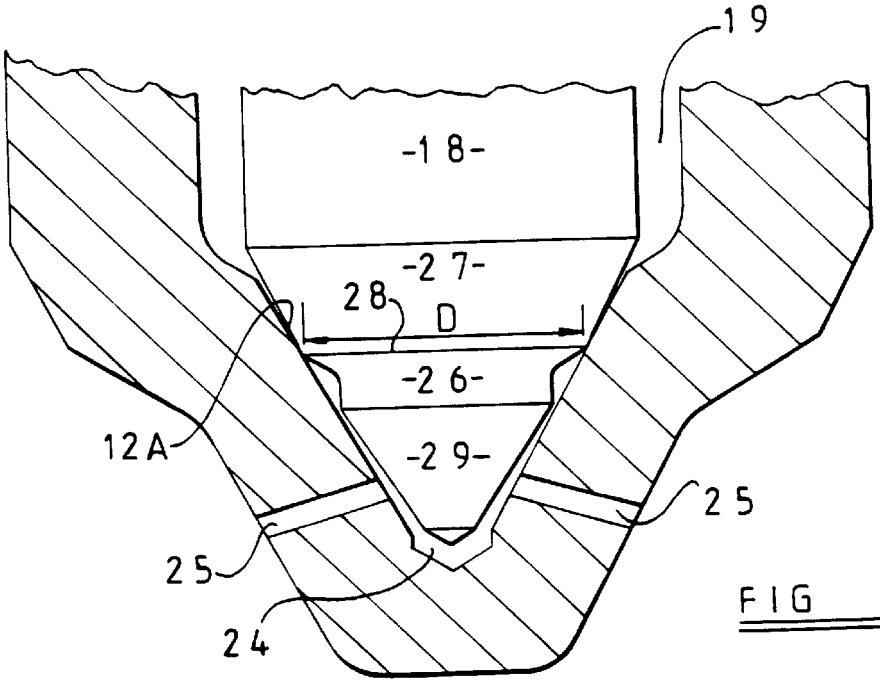
FIG. 2 is a view to an enlarged scale of part of the nozzle seen in FIG. 1.

Turning now to FIG. 2, the seating 12A is of frusto conical form and at its narrower end opens into a small recess 24 the purpose of which is to permit accurate grinding of the surface of the seating. Opening onto the seating adjacent the recess is in the particular example, a pair of outlet orifices 25. Instead of the orifices being positioned as shown they could extend from a deeper recess known in the art as a sac volume and there may be just a single orifice or more than two depending on the application.

The end of the valve member 18 is of tapering form and it is provided intermediate its ends with a circumferential groove 26. Intermediate the groove 26 and the main body of the valve member is a so called upstream conical surface 27 which has an included angle with the seating of 0.75° so that its cone angle is slightly less than that of the seating. The upstream edge of the groove forms with the surface a so called seating line indicated at 28 and having a diameter "D". The downstream edge of the groove 26 forms a boundary with a downstream seating surface 29 which has a cone angle slightly greater than that of the seating. In the closed position of the valve member there is therefore engagement between the valve member and the seating along the seating line 28 but there is a clearance between the seating and the valve member particularly in the region of the downstream edge of the groove 26.

In operation, when fuel under pressure is supplied to the inlet 13, fuel pressure acts on the end area of the valve member defined outside the seating line 28 and a force is therefore generated on the valve member in opposition to the force exerted by the spring. When the force due to the fuel pressure exceeds the spring force, the valve member moves to the open position and fuel can then flow between the valve member and the seating and through the orifices 25. The pressure which is required to lift the valve member from its seating is known in the art as the "nozzle opening pressure". When the flow of fuel from the fuel pump ceases, the pressure falls and the valve member will be returned into engagement with the seating by the action of the spring, when the fuel pressure falls to a value less than the nozzle opening pressure.

Over a period of time deformation of the seating line will take place so that it effectively becomes a zone however, the presence of the groove prevents the effective seating line moving in the downstream direction so that the nozzle opening pressure will be substantially unaffected. This enables the included angle between the downstream conical surface 29 and the seating to be made as small as possible. In the example, the included angle is 2.5°. The junction of the two conical surfaces would lie on the seat line but because of the groove there is no actual junction and the manufacturing difficulties of providing an accurate junction are avoided. In practice the zone contact which develops means that the effective seat line moves in the upstream direction to provide compensation for spring relaxation.

What is claimed is:

1. A fuel injection nozzle comprising a valve member slidable in a bore, and resilient means for biasing the valve member into engagement with a seating, the valve member being arranged to be lifted from the seating against the action of the resilient means by fuel under pressure being applied to the valve member, the valve member, when lifted from the seating, permitting fuel to flow past the seating to an outlet orifice, wherein the seating is machined to frusto conical form with a constant cone angle and the valve member is machined to define two conical surfaces, the downstream one in terms of the direction of flow of fuel through the outlet orifice, having a cone angle which is greater than that of the seating and the upstream one having a cone angle less than that of the seating, and a circumferential groove formed in the valve member, the upstream edge of said groove forming with the upstream conical surface a seating line along which in the closed position of the valve member the valve member engages with the seating, the downstream edge of said groove lying on the downstream conical surface.

2. A nozzle as claimed in claim 1, wherein the part of the valve member downstream of the seating line is adapted to occupy a significant proportion of the part of the bore downstream of the seating line.

3. A nozzle as claimed in claim 1, wherein the downstream conical surface is spaced from the seating when the valve member is in its closed position.

4. A nozzle as claimed in claim 1, wherein the narrower end of the seating opens into a recess.

5. A nozzle as claimed in claim 1 which the downstream one of said conical surfaces had an included angle of about 2.5° with the seating and the upstream one of said conical surfaces has an included angle of 0.75°.

* * * * *